US010339752B2

(12) United States Patent
McLenaghan et al.

(10) Patent No.: US 10,339,752 B2
(45) Date of Patent: Jul. 2, 2019

(54) METHOD OF GAMING, A GAMING SYSTEM AND A GAME CONTROLLER

(71) Applicant: Aristocrat Technologies Australia Pty Limited, North Ryde (AU)

(72) Inventors: Ben McLenaghan, Chipping Norton (AU); Oliver Crispino, Rosemeadow (AU)

(73) Assignee: Aristocrat Technologies Australia Pty Limited (AU)

( * ) Notice: Subject to any disclaimer, the term of this patent is extended or adjusted under 35 U.S.C. 154(b) by 749 days.

(21) Appl. No.: 14/952,349

(22) Filed: Nov. 25, 2015

(65) Prior Publication Data

US 2016/0171817 A1 Jun. 16, 2016

(30) Foreign Application Priority Data

Nov. 28, 2014 (AU) ..... 2014904821

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/34* (2013.01)

(58) Field of Classification Search
CPC ..... G07F 17/34
See application file for complete search history.

(56) References Cited

U.S. PATENT DOCUMENTS 6,093,102 A * 7/2000 Bennett ..... G07F 17/34 273/138.1
2009/0239632 A1* 9/2009 Leupp ..... G07F 17/3265 463/20
2014/0024431 A1* 1/2014 Joung ..... G07F 17/3265 463/20

* cited by examiner

*Primary Examiner* — Robert T Clarke, Jr.
(74) *Attorney, Agent, or Firm* — McAndrews, Held & Malloy, Ltd.

(57) ABSTRACT

An electronic method of gaming in a gaming system comprises receiving a selection of one of a plurality game options; forming, based on the selected game option, a set of symbols to be used in the generation of at least one game outcome generating a game outcome with the game controller by selecting subsets of the symbols of the respective reels of the formed set of symbols for display on a display of the gaming system in a plurality of columns of symbol display positions with which the respective reels are associated; and making an award upon the symbols displayed at the symbol display positions in the game outcome including a winning combination of symbols.

45 Claims, 11 Drawing Sheets

Equivalent
Free Game Reel Window

METHOD OF GAMING, A GAMING SYSTEM AND A GAME CONTROLLER

RELATED APPLICATIONS

This application claims priority to Australia Provisional Patent Application No. 2014904821 having an International filing date of Nov. 28, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In most current gaming systems, a player makes a wager by selecting a number of lines to play or a number of ways to win.

While such gaming systems provide players with enjoyment, a need exists for alternative gaming systems.

BRIEF SUMMARY OF THE INVENTION

In a first aspect, the invention provides an electronic method of gaming in a gaming system comprising:

receiving a selection of one of a plurality game options;

forming, based on the selected game option, a set of symbols to be used in the generation of at least one game outcome, wherein each set of symbols comprises a plurality of reels of symbols, the symbols of each reel being located at respective ones of a plurality of symbol positions, and wherein for each set of symbols the symbols at some of the symbol positions are fixed while symbols at one or more of a plurality of designated symbol positions are selected, and wherein for a first game option, forming the set of symbols includes randomly selecting a mystery symbol from a set of mystery symbols for use at a first subset of the plurality of designated symbol positions and using predefined symbols at the remainder of the designated symbol positions, and for a second game option, forming the set of symbols includes randomly selecting at least one mystery symbol from the set of mystery symbols for use at a first subset of the plurality of designated symbol positions and a second subset of the plurality of designated symbol positions;

generating a game outcome with the game controller by selecting subsets of the symbols of the respective reels of the formed set of symbols for display on a display of the gaming system in a plurality of columns of symbol display positions with which the respective reels are associated; and making an award upon the symbols displayed at the symbol display positions in the game outcome including a winning combination of symbols.

In an embodiment, each subset of designated symbol positions corresponds to a respective reel.

In an embodiment, there is a subset of designated symbols for each reel.

In an embodiment, the plurality of designated positions are contiguous.

In an embodiment, the symbols at least two symbol positions of at least one of the subsets of designated symbol positions are different to one another.

In an embodiment, the symbols at least two symbol positions of each of the respective subsets of designated symbol positions are different to one another.

In an embodiment, there are N reels, N game options, and N subsets of designated symbols, and wherein for each of game options 1 to N−1, predefined symbols are used at the remainder of the designated symbol positions.

In an embodiment, randomly selecting at least one mystery symbol for more than one subset of the plurality of designated symbol positions comprises selecting a common mystery symbol to be used in respect of all of the respective subsets.

In an embodiment, randomly selecting at least one mystery symbol for more than one subset of the plurality of designated symbol positions comprises separately randomly selecting a mystery symbol for each of the respective subsets.

In an embodiment, the method comprises for a further game option, forming the set of symbols by using predefined symbols at each of the designated symbol positions.

In an embodiment, the method comprises evaluating the symbols displayed at the symbol display positions to determine whether a trigger condition is met, and upon the trigger condition being met generating at least one further game outcome, and making an award upon the symbols of the at least one further outcome including a winning combination of symbols.

In an embodiment, the method comprises, for at least one game option, treating the mystery symbol of at least one subset of display positions as a wild symbol during the further game outcome.

In an embodiment, the method comprises, for at least one game option, changing the mystery symbol of at least one subset of display positions to a wild symbol.

In an embodiment, the method comprises treating any other symbols on the same reel as the mystery symbol that match the mystery symbol as a wild symbol.

In an embodiment, the method comprises changing any other symbols on the same reel as the mystery symbol that match the mystery symbol to a wild symbol.

In a second aspect, the invention provides a gaming system comprising:

a display;

a game play mechanism operable by a player to select one of a plurality of game play options; and a game controller configured to form, based on selected game option, a set of symbols to be used in the generation of at least one game outcome, wherein each set of symbols comprises a plurality of reels of symbols, the symbols of each reel being located at respective ones of a plurality of symbol positions, and wherein for each set of symbols the symbols at some of the symbol positions are fixed while symbols at one or more of a plurality of designated symbol positions are selected, and wherein for a first game option, formation of the set of symbols includes the game controller randomly selecting a mystery symbol from a set of mystery symbols for use at a first subset of the plurality of designated symbol positions and using predefined symbols at the remainder of the designated symbol positions, and for a second game option, formation of the set of symbols includes the game controller randomly selecting at least one mystery symbol from the set of mystery symbols for use at a first subset of the plurality of designated symbol positions and a second subset of the plurality of designated symbol positions;

generate a game outcome with the game controller by selecting subsets of the symbols of the respective reels of the formed set of symbols for display on the display of in a plurality of columns of symbol display positions with which the respective reels are associated; and make an award upon the symbols displayed at the symbol display positions in the game outcome including a winning combination of symbols.

In an embodiment, each subset of designated symbol positions corresponds to a respective reel.

In an embodiment, there is a subset of designated symbols for each reel.

In an embodiment, the plurality of designated positions are contiguous.

In an embodiment, the symbols of at least one of the subsets of designated symbol positions are different to the symbols of at least one other of the subsets of designated symbol positions.

In an embodiment, the symbols of each of the respective subsets of designated symbol positions are different to the symbols of the other subsets of designated symbol positions.

In an embodiment, there are N reels, N game options, and N subsets of designated symbols, and wherein for each of game options 1 to N−1, predefined symbols are used at the remainder of the designated symbol positions.

In an embodiment, the game controller randomly selecting at least one mystery symbol for more than one subset of the plurality of designated symbol positions comprises the game controller selecting a common mystery symbol to be used in respect of all of the respective subsets.

In an embodiment, the game controller randomly selecting at least one mystery symbol for more than one subset of the plurality of designated symbol positions comprises the game controller separately randomly selecting a mystery symbol for each of the respective subsets.

In an embodiment, for a further game option, the game controller forms the set of symbols by using predefined symbols at each of the designated symbol positions.

In an embodiment, the game controller evaluates the symbols displayed at the symbol display positions to determine whether a trigger condition is met, and upon the trigger condition being met generates at least one further game outcome, and makes an award upon the symbols of the at least one further outcome including a winning combination of symbols.

In an embodiment, the game controller, for at least one game option, treats the mystery symbol of at least one subset of display positions as a wild symbol during the further game outcome.

In an embodiment, the game controller, for at least one game option, changes the mystery symbol of at least one subset of display positions to a wild symbol.

In an embodiment, the game controller treats any other symbols on the same reel as the mystery symbol that match the mystery symbol as a wild symbol.

In an embodiment, the game controller changes any other symbols on the same reel as the mystery symbol that match the mystery symbol to a wild symbol.

In a third aspect, the invention provides a game controller for a gaming system, the game controller comprising:

a symbol set former configured to form, based on the selected game option, a set of symbols to be used in the generation of at least one game outcome, wherein each set of symbols comprises a plurality of reels of symbols, the symbols of each reel being located at respective ones of a plurality of symbol positions, and wherein for each set of symbols the symbols at some of the symbol positions are fixed while symbols at one or more of a plurality of designated symbol positions are selected, and wherein for a first game option, formation of the set of symbols includes the symbol set former randomly selecting a mystery symbol from a set of mystery symbols for use at a first subset of the plurality of designated symbol positions and using predefined symbols at the remainder of the designated symbol positions, and for a second game option, formation of the set of symbols includes the symbol set former randomly selecting at least one mystery symbol from the set of mystery symbols for use at a first subset of the plurality of designated symbol positions and a second subset of the plurality of designated symbol positions;

an outcome generator configured to generate a game outcome by selecting subsets of the symbols of the respective reels of the formed set of symbols for display on a display of the gaming system in a plurality of columns of symbol display positions with which the respective reels are associated; and an outcome evaluator configured to make an award upon the symbols displayed at the symbol display positions in the game outcome including a winning combination of symbols.

In an embodiment, each subset of designated symbol positions corresponds to a respective reel.

In an embodiment, there is a subset of designated symbols for each reel.

In an embodiment, the plurality of designated positions are contiguous.

In an embodiment, the symbols of at least one of the subsets of designated symbol positions are different to the symbols of at least one other of the subsets of designated symbol positions.

In an embodiment, the symbols of each of the respective subsets of designated symbol positions are different to the symbols of the other subsets of designated symbol positions.

In an embodiment, there are N reels, N game options, and N subsets of designated symbols, and wherein for each of game options 1 to N−1, predefined symbols are used at the remainder of the designated symbol positions.

In an embodiment, the game controller randomly selecting at least one mystery symbol for more than one subset of the plurality of designated symbol positions comprises the game controller selecting a common mystery symbol to be used in respect of all of the respective subsets.

In an embodiment, the game controller randomly selecting at least one mystery symbol for more than one subset of the plurality of designated symbol positions comprises the game controller separately randomly selecting a mystery symbol for each of the respective subsets.

In an embodiment, for a further game option, the game controller forming the set of symbols by using predefined symbols at each of the designated symbol positions.

In an embodiment, the game controller evaluates the symbols displayed at the symbol display positions to determine whether a trigger condition is met, and upon the trigger condition being met generates at least one further game outcome, and makes an award upon the symbols of the at least one further outcome including a winning combination of symbols.

In an embodiment, the game controller, for at least one game option, treats the mystery symbol of at least one subset of display positions as a wild symbol during the further game outcome.

In an embodiment, the game controller, for at least one game option, changes the mystery symbol of at least one subset of display positions to a wild symbol.

In an embodiment, the game controller treats any other symbols on the same reel as the mystery symbol that match the mystery symbol as a wild symbol.

In an embodiment, the game controller changes any other symbols on the same reel as the mystery symbol that match the mystery symbol to a wild symbol.

In a fourth aspect, the invention provides gaming system comprising:

display means;

means for receiving a selection of one of a plurality game options;

means for forming, based on the selected game option, a set of symbols to be used in the generation of at least one game outcome, wherein each set of symbols comprises a plurality of reels of symbols, the symbols of each reel being located at respective ones of a plurality of symbol positions, and wherein for each set of symbols the symbols at some of the symbol positions are fixed while symbols at one or more of a plurality of designated symbol positions are selected, and wherein for a first game option, forming the set of symbols includes randomly selecting a mystery symbol from a set of mystery symbols for use at a first subset of the plurality of designated symbol positions and using predefined symbols at the remainder of the designated symbol positions, and for a second game option, forming the set of symbols includes randomly selecting at least one mystery symbol from the set of mystery symbols for use at a first subset of the plurality of designated symbol positions and a second subset of the plurality of designated symbol positions;

means for generating a game outcome with the game controller by selecting subsets of the symbols of the respective reels of the formed set of symbols for display on the display means in a plurality of columns of symbol display positions with which the respective reels are associated; and means for making an award upon the symbols displayed at the symbol display positions in the game outcome including a winning combination of symbols.

In a fifth aspect, the invention provides computer program code which when executed implements the above method.

In a sixth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
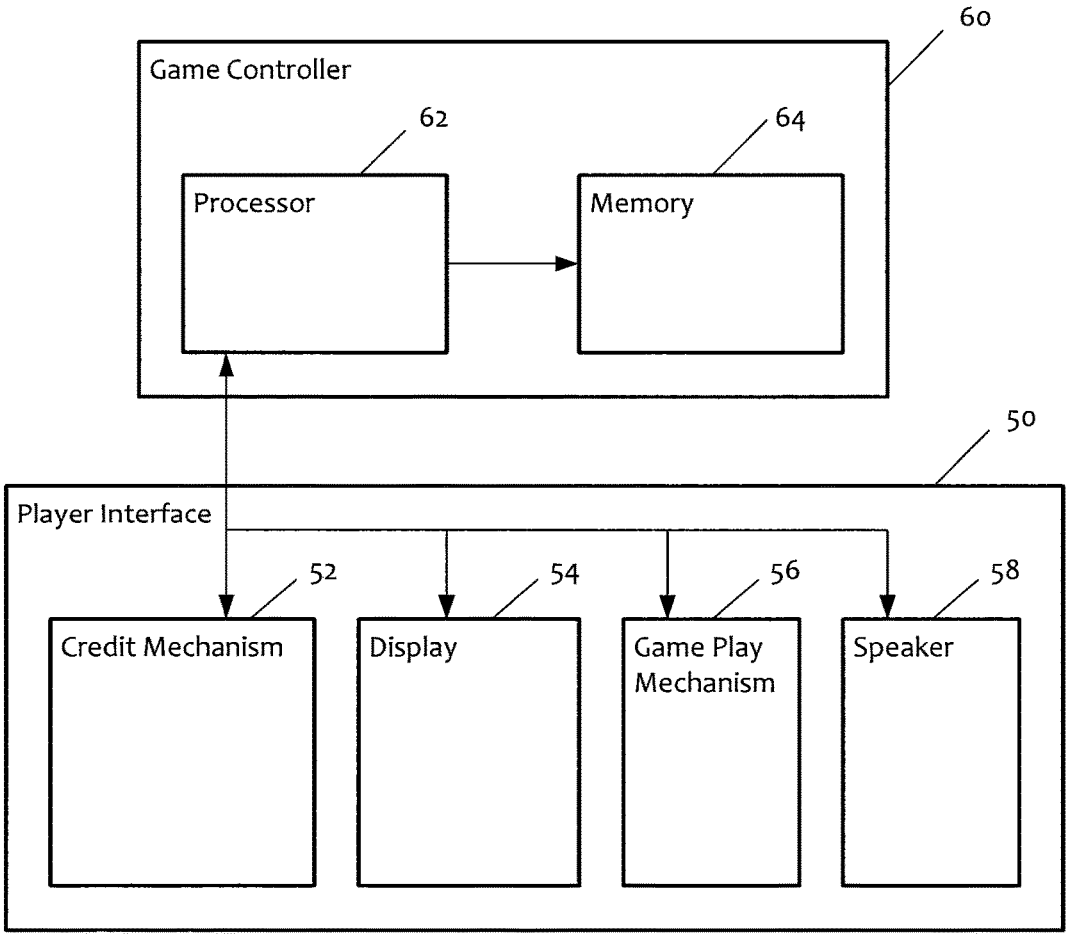
FIG. 1 is a block diagram of the core components of a gaming system.

Referring to the drawings, there is shown a gaming system having a game controller having components that enable the implementation of a game where the player can select between a different game options which affect the formation of a set of symbols used to generate a game outcome. Depending on the selected option a different numbers of symbol positions on the reels are activated to be populated with mystery symbols, that is a symbol selected at random from a mystery symbol set. In an embodiment, game play options correspond to an incrementing number of reels having activated symbol positions. In an embodiment, the same mystery symbol is selected at random for each reel. In another embodiment, a mystery symbol is separately randomly selected for each reel. Once a set of symbols has been formed, a game outcome is generated and valuated. Awards are made for winning combinations.

In an embodiment, a feature game comprising a plurality of free games may be activated. In the free games the same mystery symbol is selected at random for each reel. When the mystery symbol appears on one or more designated reels, occurrences of the mystery symbol on the designated reels are changed into a wild symbol before being evaluated.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
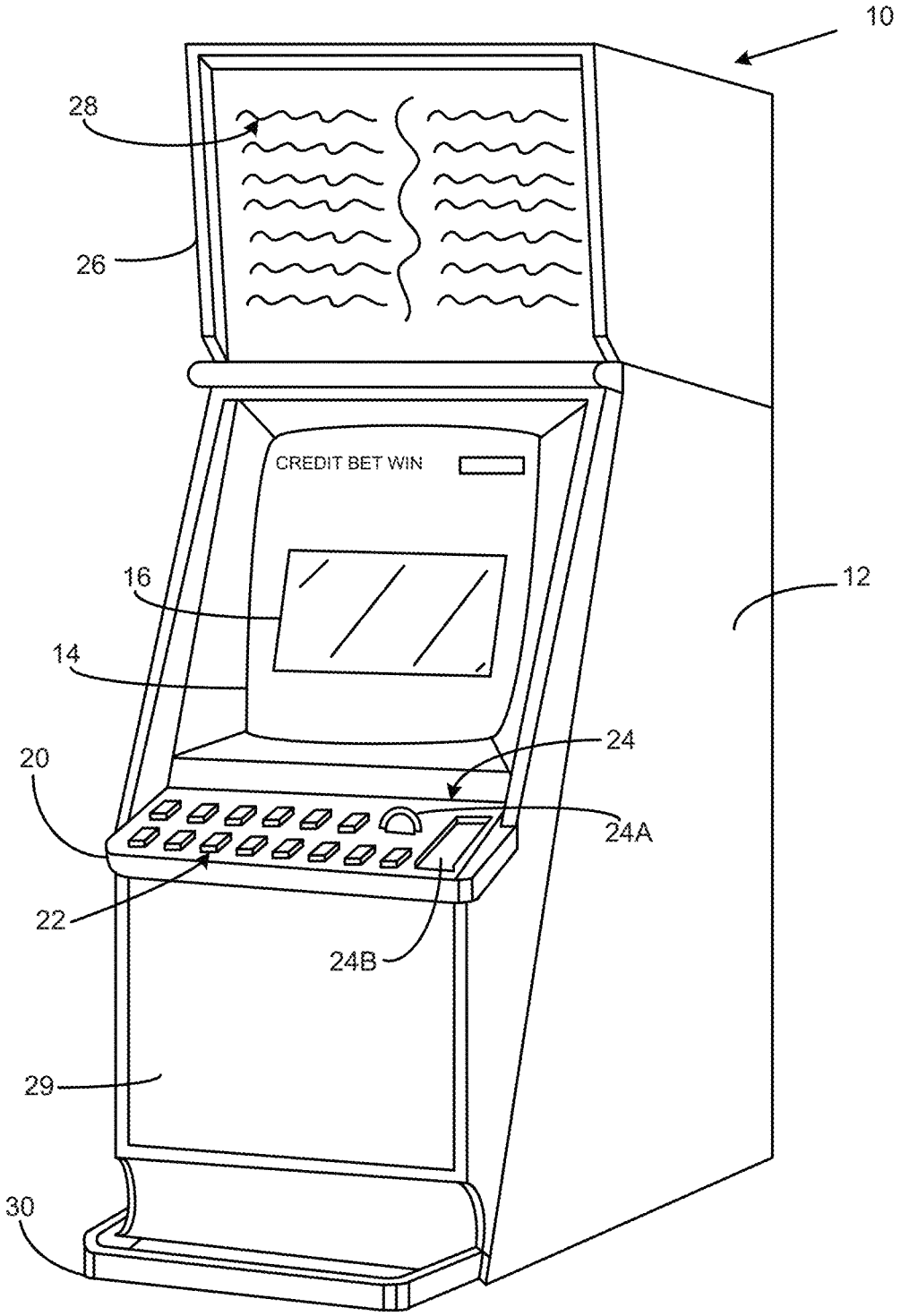
FIG. 2 is a perspective view of a stand alone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of liquid crystal display unit. Alternatively, the display 14 may be a plasma screen or any other suitable video display unit. The top box 26 may also include a display which may be of the same type as the display 14, or of a different type.

Figure 3:
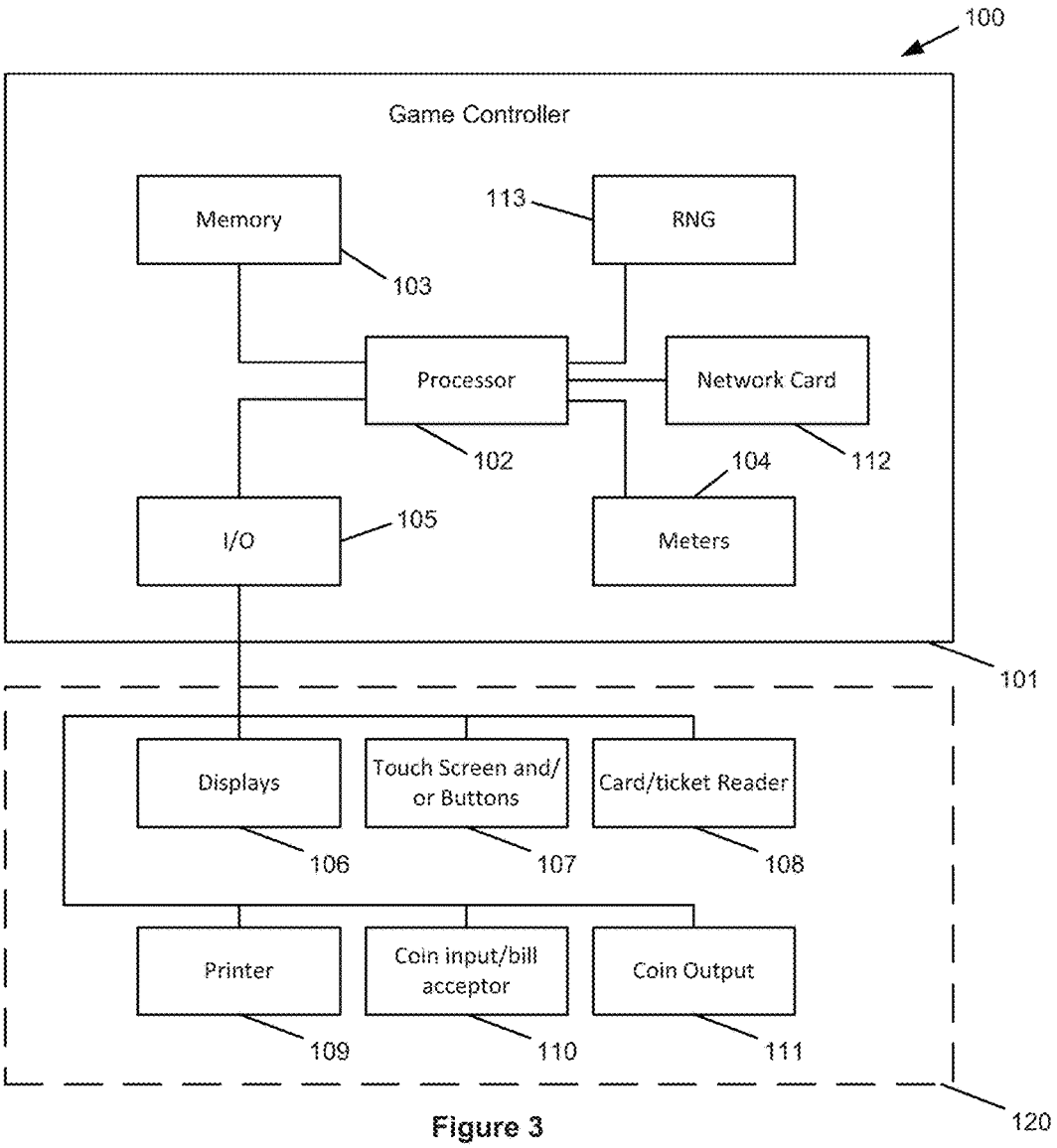
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
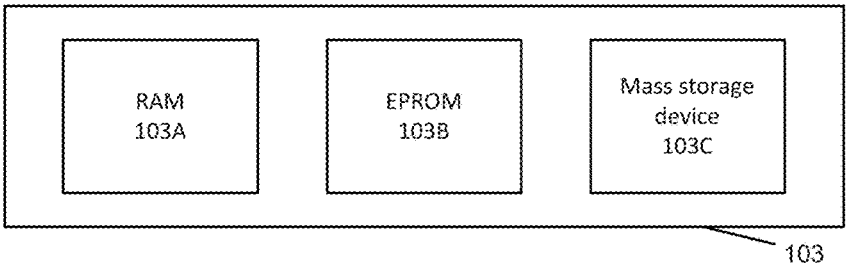
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/ output devices 106,107,108,109,110,111 to be provided remotely from the game controller 101.

Figure 5:
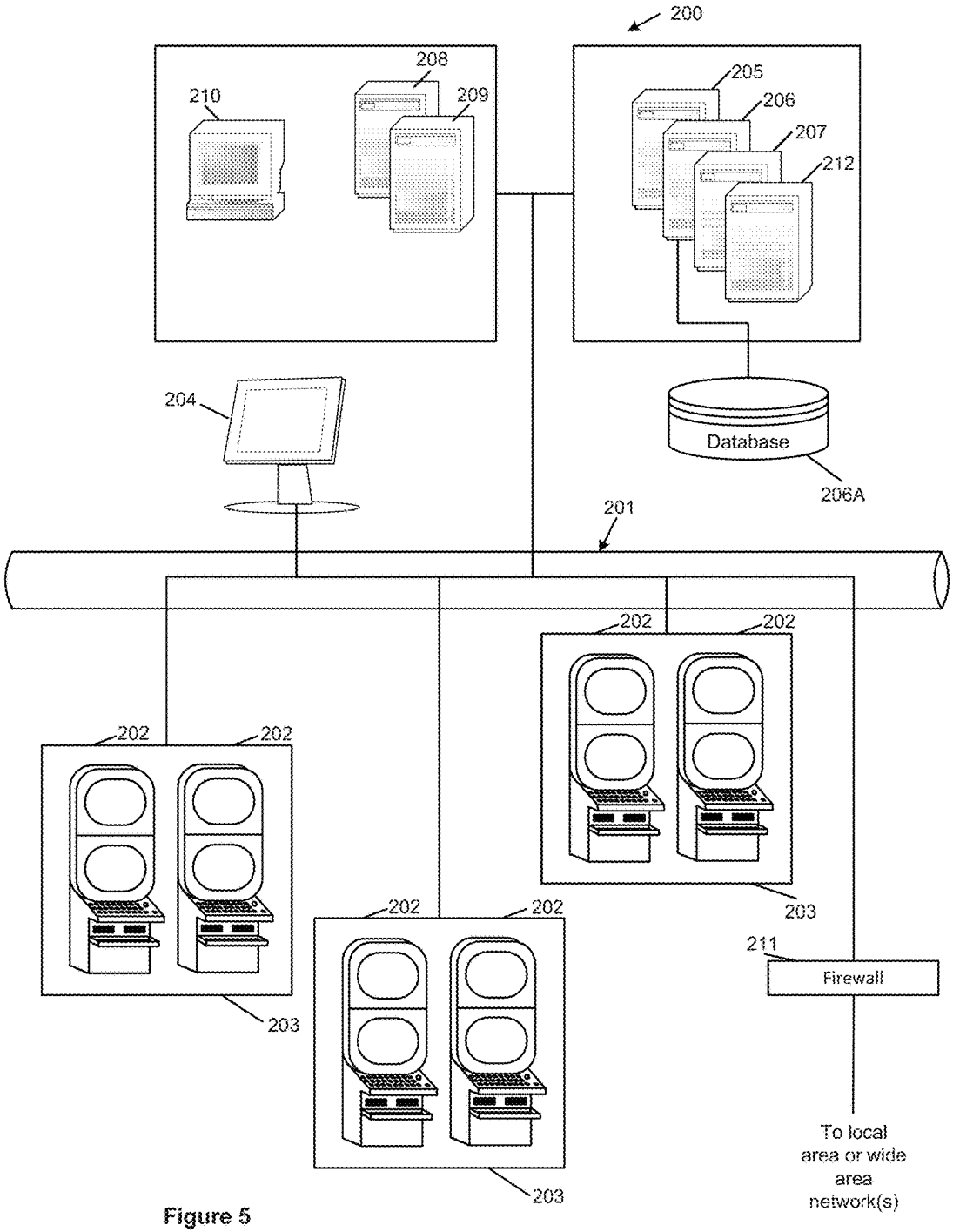
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to select one of a plurality of game options, each of which has a different effect on the formation of a set of symbols used to generate a game outcome. In an embodiment, there is a button for each for each option. In the examples given in connection with the embodiments below, there are five options corresponding to the number of reels used in the game. However, in other embodiments, the number of game options could vary, for example with the number of reels. The number of game options need not match the number of reels. For example, in an embodiment where there are five reels, there may be a sixth game option which results in the use of a base set of symbols with no mystery symbols being selected. In other embodiments there may be fewer game options than the number of reels. In the embodiments, the game options correspond to a selected mystery symbol being placed at different numbers of designated symbol positions. In the embodiments, each game option has an associated cost in credits. The cost in credits is larger for those options where a larger number of mystery symbols are used. In some embodiments, the player is also able to operate the game play mechanism 56 to select a number of credits to wager on the game option. The selected number of credits acts as a multiplier to the cost in credits as well as to the amount paid from the pay table.

In an embodiment, irrespective of the game play option selected by the player, the game outcome is evaluated in the same way to determine whether the selected symbols of the game outcome correspond to a winning outcome. In one embodiment, each displayed symbol of each reel can be used to form symbol combinations with symbols displayed at a designated with each displayed symbol of each of the other reels with one symbol display position of each reel being used in any combination. For example, if there are five reels and three symbol display positions for each reel such that the symbol display positions comprise three rows, the total number of ways to win is determined by multiplying the number of symbol display positions of each reels. As a result for five reels and fifteen display positions there are 243 ways to win. For five reels and four symbol display positions per reel there are 1024 ways to win.

Figure 6:
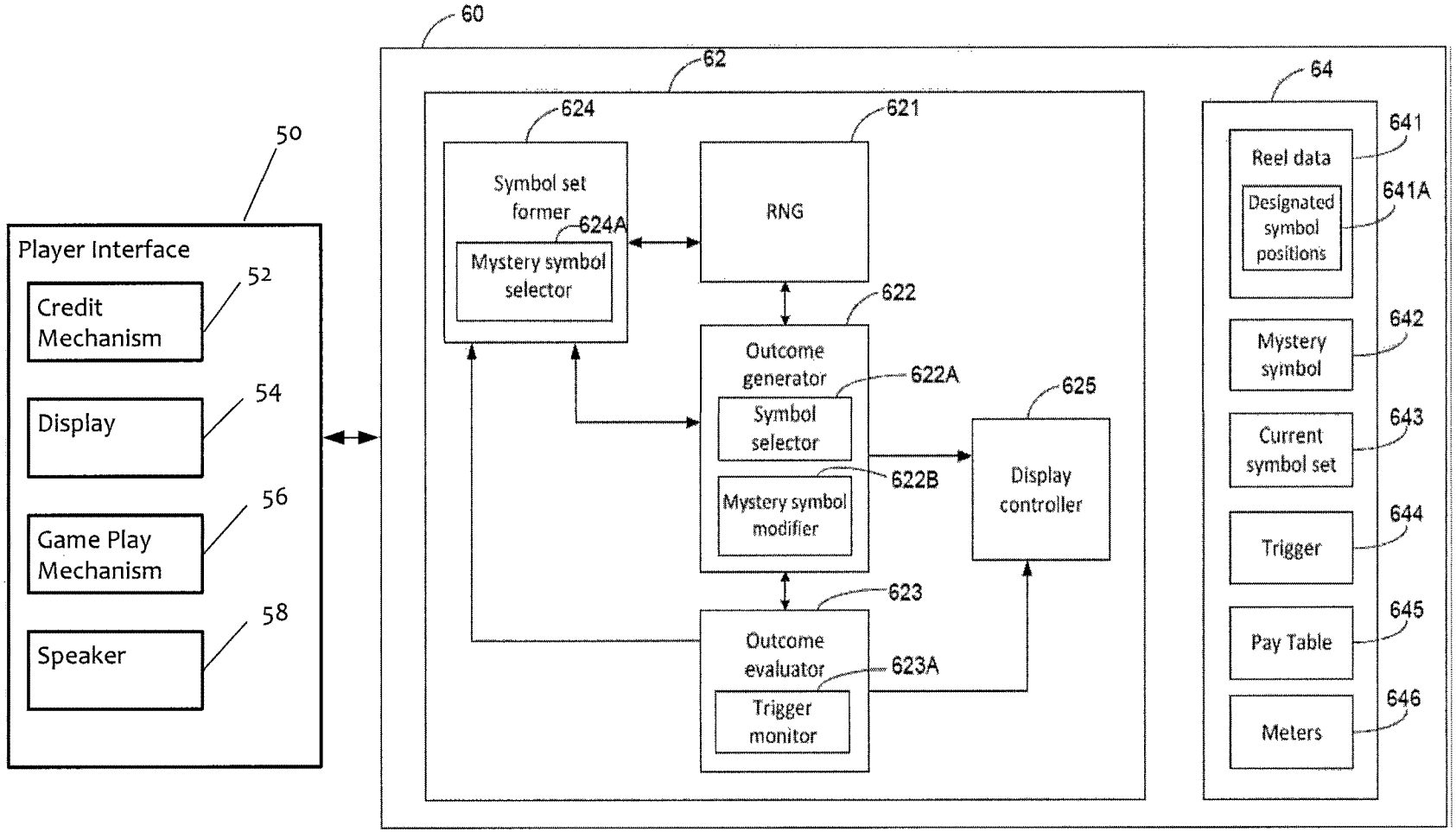
FIG. 6 is a further block diagram of a gaming system.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

Figure 8:
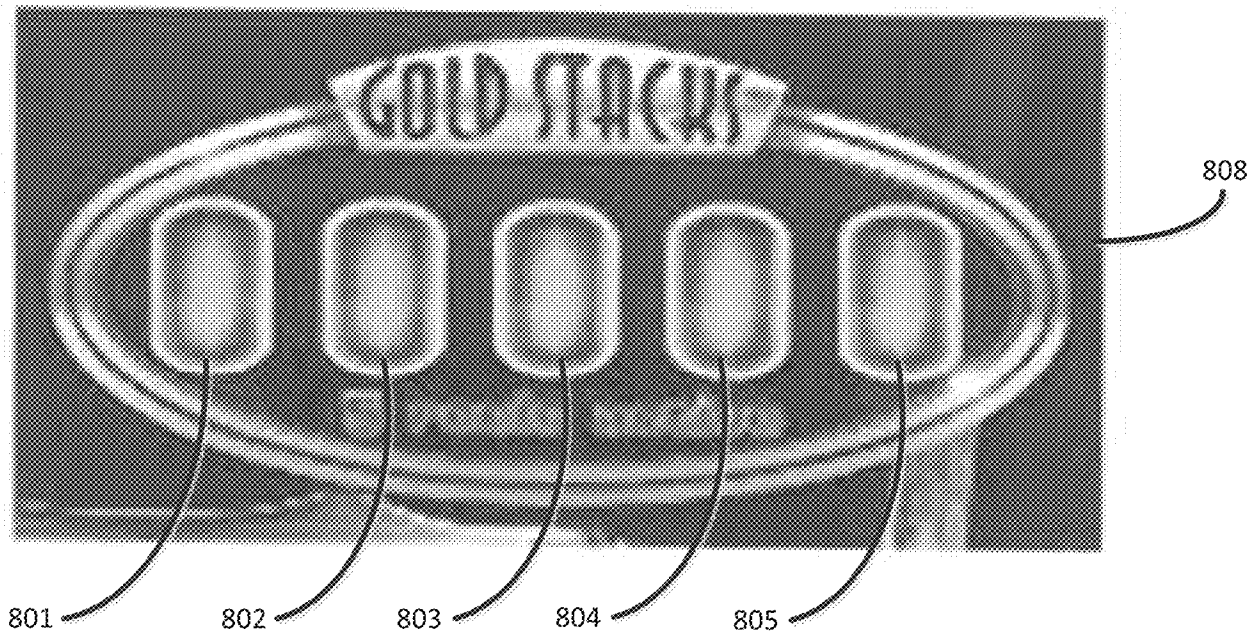
FIG. 8 is an example of a player interface displaying a selection of a game option.

In the embodiment, there are five subsets of designated symbols corresponding to respective ones of the five reels. Accordingly, the player's game play options are to select a number of reels to "activate" to have a mystery symbol placed on the reel—that is to select the subsets of designated symbols of the respective reels be populated. An example of part of the display 808 of the gaming machine shown in FIG. 8 from which is can be seen that there are five symbols 801,802,803,804,805 are either lit up or greyed out in order to indicate the number of reels that are active and for which a mystery symbol will be selected. In the example shown in FIG. 8, the player has selected five reels.

Figure 9:
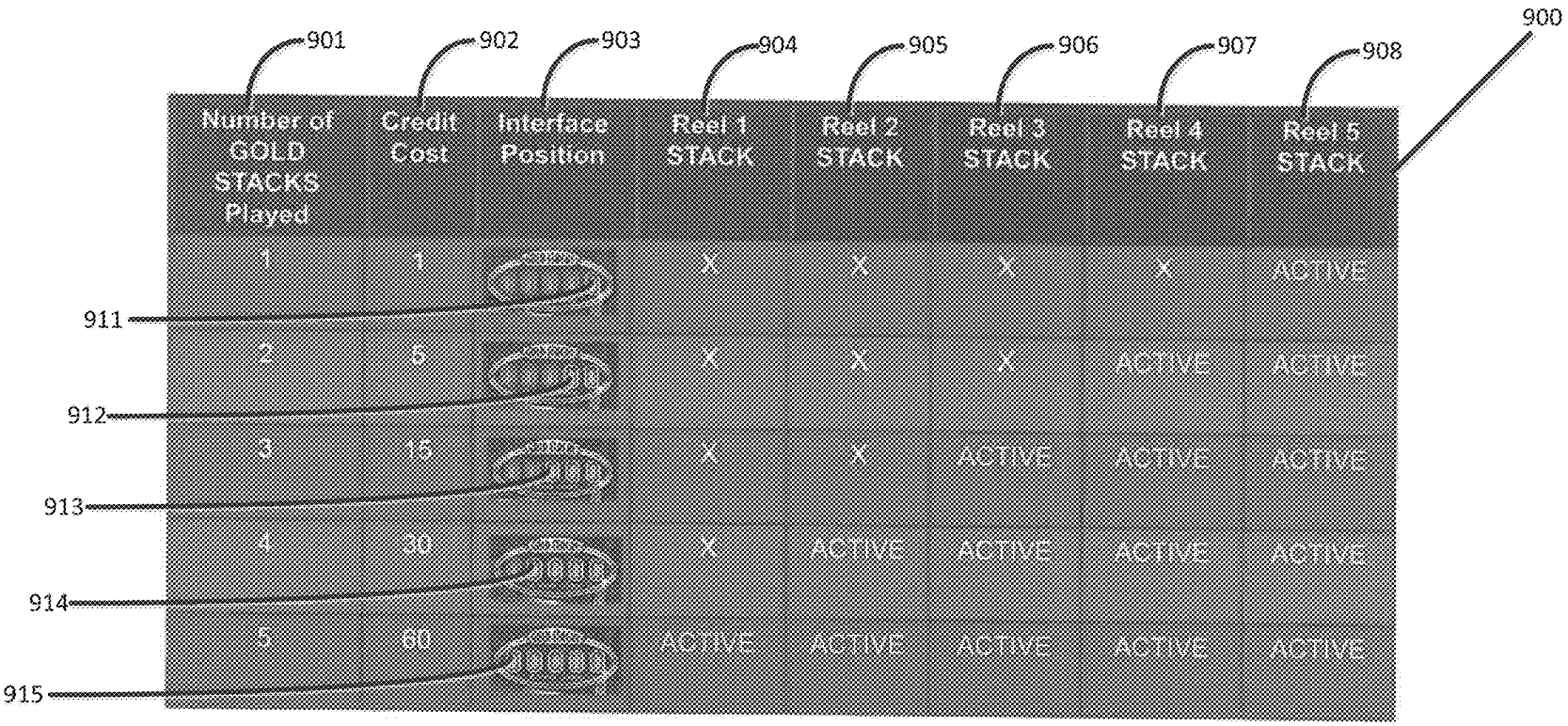
FIG. 9 is a table showing an example of game options available to a player and the impact of those game options.

Referring to FIG. 9, there is shown a table 900 which indicates an example of the activation patterns of an embodiment. In the example, of FIG. 9, the subsets of designated symbols are located at contiguous positions on the reels and are displayed with a gold background when active. Accordingly, they are referred to in the game as "gold stacks". A first column 901, shows the number of gold stacks played. This defines the number of reels on which the subsets of designated symbols will be active. In a typical embodiment, there will be three to five symbols in a stack. In an embodiment, the number of symbols in a stack corresponds to the number of symbols in each column. In other embodiments, the designated symbols could be distributed differently, for example, spread out amongst the reels.

Column 902 shows the credit cost corresponding to the number of gold stacks played. It will be seen that the credit cost increases with the number of stacks played.

Column 903 shows the position of the interface in response to the selection of a number of gold stacks. That is, what would be displayed in the area of display 808 shown in FIG. 8 depending on the player's selection. It will be observed that when a player selects a single stack, a single light 911 is illuminated then when a player selects an additional stack (two stacks) light 912 is shown as illuminated in gold in addition to light 911. Selection of each of the additional option results in the lighting of and additional light 913, 914 and 915 such that when playing five stacks, five lights 911-915 are lit.

Columns 904 to 908 show the status of each of the reels depending on the player's selection in these columns, the word "active" indicates that the stack is active whereas the symbol "X" indicates that a stack is inactive. It will be apparent from the table 900 of FIG. 9 that the stacks are activated from right to left. This is because in the embodiment the winning combinations are evaluated from left to right. Accordingly, stacks located towards the left most column are more likely to deliver winning combinations in the game.

Referring now again to FIG. 6, memory 64 stores reel data 641 which defines a number of reels, in this embodiment five reels. The reels are defined by a number of symbol positions. Symbols are allocated to the respective symbol positions in advance with the exception of certain symbol positions which are allocated dynamically. These are the designated symbol positions 641A. In the embodiment, there is a stack of designated symbol positions on each of the reels and different numbers of the stacks of designated symbol positions (i.e. a group of contiguous symbol positions) are populated depending on the game play option selected by the player and received by the game controller 60. In the embodiment, four of the reels have default symbols which will be displayed at the designated symbol positions if they are not activated. In an embodiment, the default symbols are symbols which have a relatively low value in the pay table. In this respect, in one example, the symbols on the reels may include picture symbols and (for example five different picture symbols themed to the game), and royal symbols. In one example, the picture symbols correspond to winning combinations having a relatively high value in the pay table and the royal symbols have a relatively low value in the pay table 645. The default symbols that are displayed on inactive reels are a stack of royal symbols. In an embodiment, a background colour is applied to each of the default symbols in the stack which is different to the normal colour of those royal symbols in order to enable a player to identify an inactive stack, that is, in order to identify those symbols which would have been replaced by a mystery symbol if the player had selected to activate the designated symbol positions 641A on the respective reel.

It will be apparent from the above embodiment, that in the example shown in FIG. 9, there is no need for there to be default symbols on the fifth reel because these symbols will be populated with a mystery symbol on each play of the game. In other embodiments, there may be a further play option where no mystery symbols are activated, in which case, default symbols could also be placed on the fifth reel.

Referring to FIG. 6, the memory 64 also stores the identity of the mystery symbols 642. In an embodiment, the mystery symbols are the same as the picture symbols, PIC 1 to PIC 5 used in the reel data so that selection of a specific mystery symbol will increase the probability of winning combinations incorporating the selected mystery symbol occurring on the reels. Mystery symbols may also have associated weightings to control the probability of a specific one of the mystery symbols being selected. For example, by making it less probable that the highest paying one of the picture symbols is selected.

When the symbol set former 624 receives the selected game option, mystery symbol selector 624A uses random number generator 621 to generate a value and compares this to ranges of values assigned to the respective mystery symbols 642 to determine which mystery symbol should be selected based on the return value from the random number generator. The selected mystery symbol is then placed in relevant subsets of designated symbol positions to form a current symbol set 643.

The outcome generator 622 operates after the symbol set has been formed. The outcome generator 622 generates a game outcome which will then be evaluated by outcome evaluator 623. Generating the game outcome involves symbol selector 622A selecting symbols from the current set of symbols 643 using random number generator 621. The selected symbols are advised to the display controller 625 which causes them to be displayed on display 54 at a set of display positions.

One example of selecting symbols is for the symbol selector 622A to select a stopping position for each of the reels at random. That is, for each of the reels, the symbol selector uses RNG 621 to select which position of the respective reel (and hence the symbol at that position) will be displayed at a defined position in the column of symbol display positions associated with the respective one of the plurality of spinning reels. For example, by selecting which symbol will appear at the bottom symbol display position. The sequence of symbols for each reel controls the other symbols displayed for that reel, so that a subset of contiguous symbols from each reel are displayed. In one example, four symbols of each of five reels may be displayed such that symbols are displayed at twenty display positions on display 54. It is known to use a probability table stored in memory 64 to vary the odds of a particular stop position being selected. Other techniques can be used to control the odds of particular outcomes occurring to thereby control the return to player of the game.

In an embodiment, the current symbol set is only used in the base game and a new symbol set is formed if a feature game is triggered. In the embodiments, the feature game is a series of free game events, in the form of a plurality of free games and a new symbol set is selected for each free game. Depending on the embodiment, the trigger event may be a symbol combination in the game, occurrence of a specific symbol in the game, based on a random evaluation, etc.

In the embodiments, a winning combination will result in some form of award being made such as an award of credits. Thus, if winning a winning combination occurs, the win meter of meters 646 is updated. Such an award may never actually be physically received by a player. For example, many gaming systems provide a player with a double or nothing gamble feature, where the player can double or forfeit their credits before commencing another play of the game or cashing. Starting another play of the game will cause the credits to be transferred to the credit meter of meters 646. Further, as credits are fungible, once credits have been added to the credit meter it is not possible to distinguish between credits which exist because the player has input cash or the like and credits resulting from an award.

In an embodiment, outcome evaluator 623 includes a trigger monitor 623A. In the embodiment, upon the selected symbols displayed at symbol display positions in the game outcome including a defined trigger or triggers 644, trigger monitor 623A triggers a series of free games.

In one example, the number of free games may depend on which of a plurality of trigger events occurs. For example, the number of free games may be based on a number of scatter symbols.

In another example, the player may be able to select the number of free games that will be conducted from a set of possibilities. The set of possible numbers of free games may each have an associated different multiplier. For example, a large number of free games may be associated with a relatively small multiplier being applied to winning outcomes achieved during the free games and successively smaller numbers of free games may be associated with successively higher multipliers. In this way, the player's selection affects the volatility of their free games. That is, the larger number of games with a lower multiplier will tend to deliver a relatively large number of small wins whereas a small number of free games will deliver fewer wins but of potentially higher value.

In the embodiment, once the outcome evaluator triggers a series of free games, the number of free games is conducted by the game controller until the count of free games reaches zero. In the embodiment, for each free game, a further mystery symbol is selected by the mystery symbol selector 624A from mystery symbol data 642 in the same way as described above. The symbol set former 624 uses the selected mystery symbol to form the current symbol set 643 which is used by symbol selector 622A of outcome generator 622 to generate a game outcome that will be evaluated by the outcome evaluator 623 to determine whether it includes an winning combinations based on pay table 645. If winning combinations are included, the win meter of meters 646 is updated. At the conclusion of the free games, the wins are transferred to the credit meter (assuming that they are not gambled).

In an embodiment, the outcome generator includes a mystery symbol modifier 622B, which modifies the appearance and function of the mystery symbol should it appear at certain positions on the display.

Figure 11A:
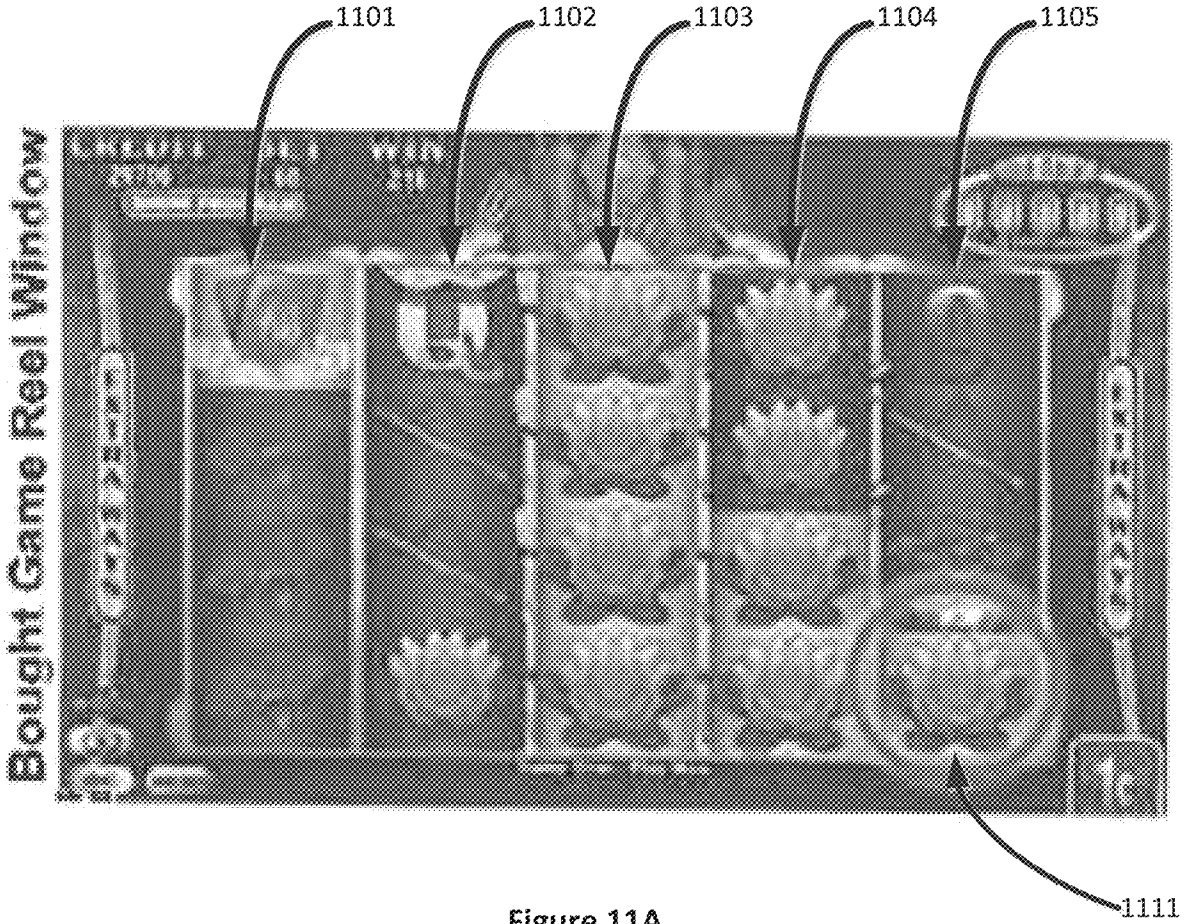
FIGS. 11A and 11B illustrate an example a feature game of an embodiment of the invention.
Figure 11B:
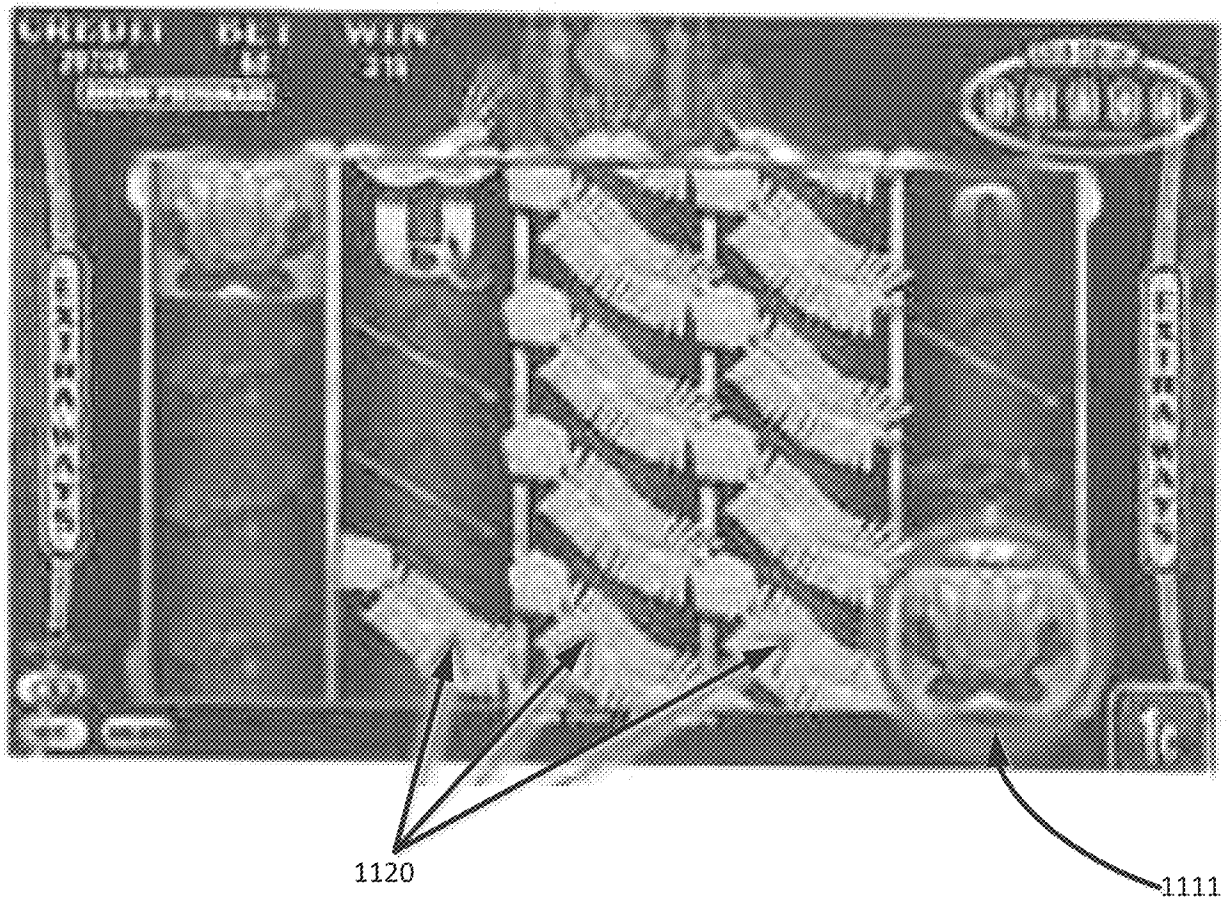

Referring to FIGS. 11A and 11B, during the free games, all symbols displayed at symbol display positions on reels 2, 3 and 4 (as numbered from left to right) that are the same as the mystery symbol for the specific feature game become feature WILD symbols. In this respect, in FIGS. 11A and 11B, the first to fifth reels 1101 to 1105 each have four symbol display positions. It will be appreciated that the middle or third reel 1103 has a stack of four symbols which correspond to mystery symbols (in this example a lotus symbol). There are also two mystery symbols with a dark background color in column 1104, one mystery symbol with the dark background color at the bottom of column 1102 and a further mystery symbol 1111 at the bottom of column 1105. As shown in FIG. 11B, each of the mystery symbols on reels 2 to 4 are transformed into a different symbol by mystery symbol modifier 622B, in this example a feature WILD symbol 1120. Symbol 1111 is not transformed because it is not in the second, third or fourth reel. It will be appreciated that while in this embodiment, the mystery symbol modifier 622B changes the symbol to feature WILD symbol 1120, in other embodiments, the mystery symbol modifier 622B may change the function of the symbols so they behave as a WILD.

Figure 10:
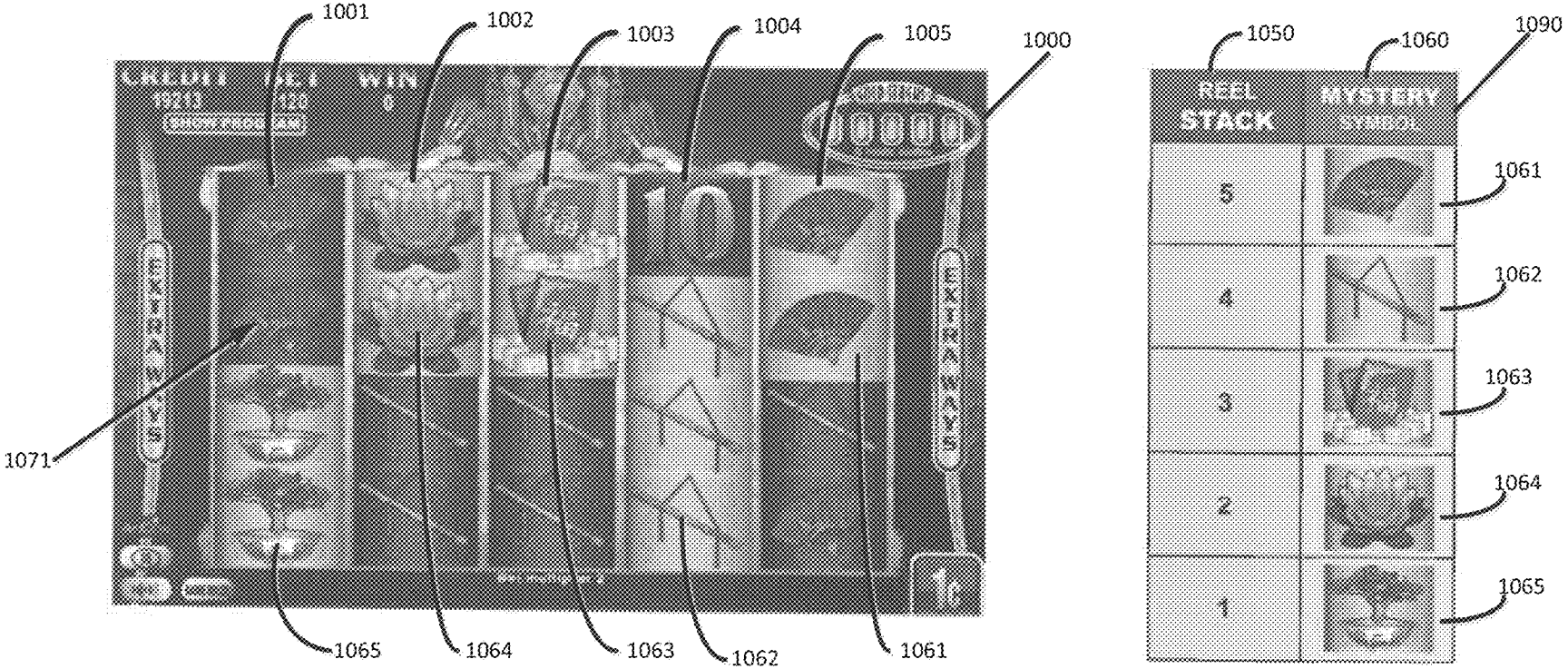
FIG. 10 is an example of an embodiment where mystery symbols are selected independently for each reel.

FIG. 10 shows an alternative embodiment where the mystery symbol is selected independently for each active reel. Key 190 shows the correspondence between each reel's stack 1050 and the mystery symbol 1060 selected for that stack. For example, it shows that a fan symbol 1061 has been selected for the fifth reel. Key 190 also shows the correspondence between symbols 1062 to 1065 which are located respectively on the fourth, third, second, and first reels. It will also be appreciated that there is a visual difference presented on the reels between symbols which are selected as mystery symbols and those which are normal picture symbols. For example, compare the gold background of fan symbol of 1061 and the grey background of fan symbol 1071.

Figure 7:
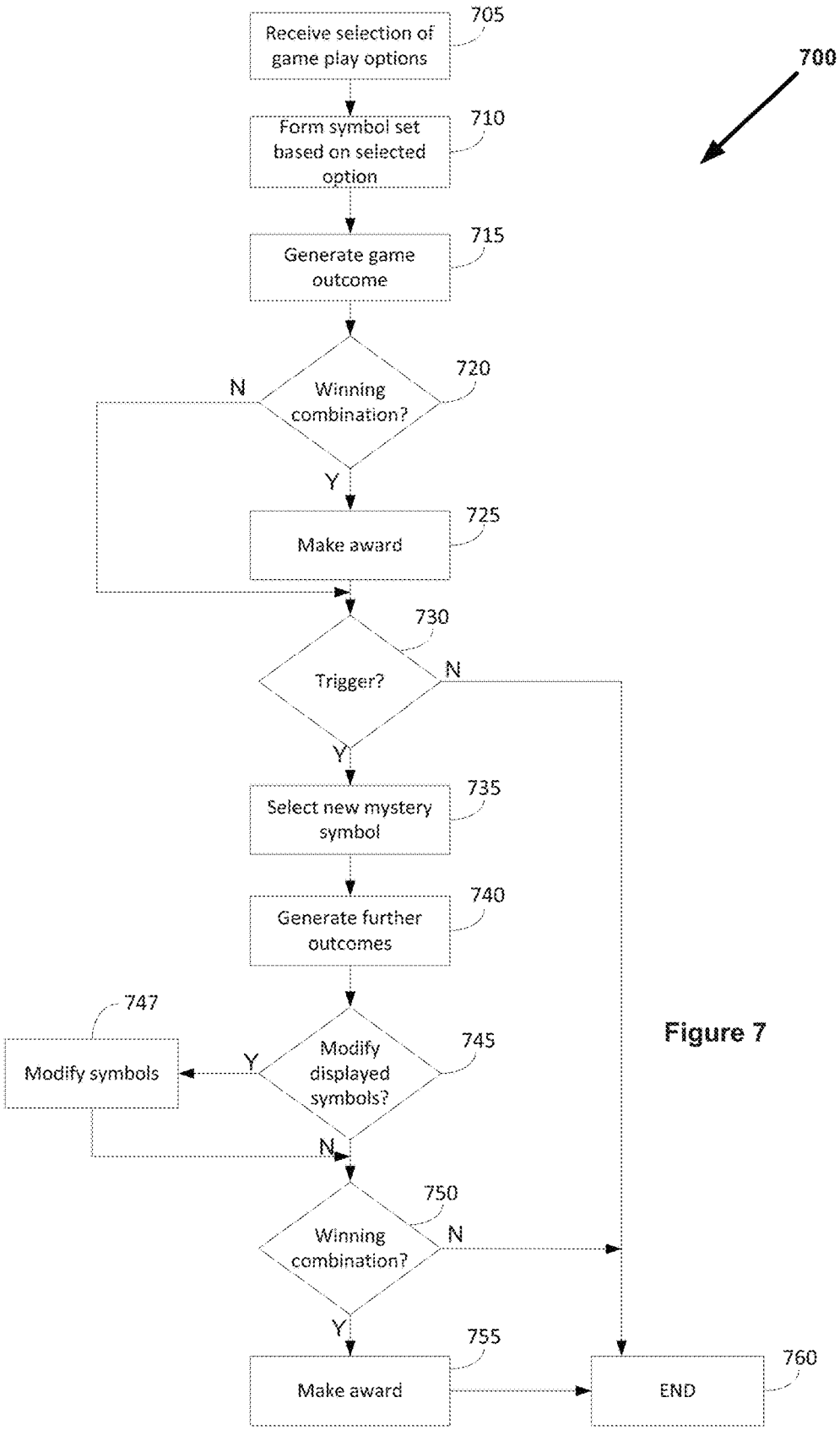
FIG. 7 is a flow chart of an embodiment.

Referring to FIG. 7, there is shown a flow chart 700 of a method of an embodiment. The method involves receiving a selection of a play option 705, forming a symbol set based on the selected option 710 and generating a game outcome 715. The method involves determining 720 whether there is a winning combination and if there is, making 725 an award. The method also involves determining 730 whether a trigger condition has been met. Upon a trigger condition being met, the method involves selecting 735 a new mystery symbol and generating 740 a further outcome. The method then involves determining whether to modify 745 the displayed symbol based on whether the mystery symbol satisfies the modification criteria. For example, has the mystery symbol been placed on reels two to four as described above. If there is to be a modification, the method involves modifying 747 the symbols before determining 750 whether there is a winning combination and any award is then made 755 otherwise the game ends 760.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming in a gaming system, wherein the gaming system comprises an input device, a display, and a game controller, the game controller comprising a processor and memory, the memory storing instructions and reel data defining at least a plurality of reels, each of the plurality of reels having a plurality of symbol positions, wherein the plurality of symbol positions include a plurality of designated symbol positions, the electronic method of gaming comprising:

selecting, by the game controller, in response to receiving an instruction from the input device, a selected game option selected from one of a plurality of game options;

forming, by the game controller, in response to the selected game option, a set of symbols for each of the plurality of reels to be used in generating at least one game outcome, wherein a symbol of the set of symbols of each of the plurality of reels being is located at a symbol position of the plurality of symbol positions, and wherein, for each of the plurality of reels, one or more of the symbols of the set of symbols at at least one of the plurality of symbol positions is fixed and the symbols of the set of symbols that are not fixed at one or more of the plurality of designated symbol positions are selected, and wherein for a first game option, forming, by the game controller, the set of symbols includes randomly selecting at least one mystery symbol from a set of mystery symbols for use at a first subset of the plurality of designated symbol positions and using predefined symbols at the designated symbol positions not used at the first subset of the plurality of designated symbol positions, and for a second game option, forming, by the game controller, the set of symbols includes randomly selecting at least one of the mystery symbols for use at the first subset of the plurality of designated symbol positions and a second subset of the plurality of designated symbol positions;

generating, by the game controller, a game outcome by selecting subsets of the symbols from the respective plurality of reels of the formed set of symbols for display on the display; and evaluating the symbols displayed at the plurality of symbol display positions in the game outcome to determine if the game outcome corresponds to a winning combination of symbols.

2. The method as claimed in claim 1, wherein each subset of the plurality of designated symbol positions corresponds to one of the plurality of reels.

3. The method as claimed in claim 2, wherein the set of symbols includes a subset of the plurality of designated symbol positions for each of the plurality of reels.

4. The method as claimed in claim 3, wherein the plurality of designated symbol positions are contiguous.

5. The method as claimed in claim 4, wherein the symbols of at least one subset of the plurality of designated symbol positions are different from the symbols of at least one other subset of the plurality of designated symbol positions.

6. The method as claimed in claim 5, wherein the symbols of each of a plurality of subsets of the plurality of designated symbol positions are different from the symbols of at least one other subset of the plurality of designated symbol positions.

7. The method as claimed in claim 1, wherein there are N reels, N game options, and N subsets of designated symbols, and wherein for each of game options 1 to N−1, the predefined symbols are used at the designated symbol positions not used at the first through $(N-1)^{th}$ subsets of designated symbol positions.

8. The method as claimed in claim 1, wherein randomly selecting at least one mystery symbol for more than one subset of the plurality of designated symbol positions comprises selecting a common mystery symbol to be used in respect of all of the subsets.

9. The method as claimed in claim 1, wherein randomly selecting at least one mystery symbol for more than one subset of the plurality of designated symbol positions comprises separately randomly selecting a mystery symbol for each of the subsets.

10. The method as claimed in claim 1, comprising, for a further game option, forming the set of symbols by using the predefined symbols at each of the plurality of designated symbol positions.

11. The method as claimed in claim 1, wherein the method comprises evaluating the symbols displayed at the plurality of symbol positions to determine whether a trigger condition is met, and, upon the trigger condition being met, generating at least one further game outcome, and making an award upon the symbols of the at least one further game outcome that includes a winning combination of symbols.

12. The method as claimed in claim 11, wherein the method comprises, for at least one of the game options, treating the at least one mystery symbol from the set of mystery symbols on a reel of the plurality of reels as a wild symbol during the further game outcome.

13. The method as claimed in claim 11, wherein the method comprises, for at least one of the game options, changing at least one mystery symbol from the set of mystery symbols on a reel of the plurality of reels to a wild symbol.

14. The method as claimed in claim 12, comprising treating any other symbols on the reel that includes the at least one mystery symbol from the set of mystery symbols on the reel of the plurality of reels as the wild symbol.

15. The method as claimed in claim 13, comprising changing any other symbols on the reel that includes the at least one mystery symbol from the set of mystery symbols to the wild symbol.

16. A gaming system comprising:

a display;

an input device, the input device receives at least one selected game option of a plurality of game play options; and a game controller comprising a processor and memory, the memory storing program code and reel data, the reel data defining at least a plurality of reels, each of the plurality of reels having a plurality of symbol positions, wherein the plurality of symbol positions include a plurality of designated symbol positions, the game controller executing instructions which cause the game controller to at least:

form, in response to the selected game option, a set of symbols for the plurality of reels to be used in generating at least one game outcome, wherein, a symbol of the set of symbols of each of the plurality of reels is located at a symbol position of the plurality of symbol positions, and wherein, for each of the plurality of reels, one or more of the symbols of the set of symbols at at least one of the plurality of symbol positions is fixed and the symbols of the set of symbols that are not fixed at one or more of the plurality of designated symbol positions are selected, and wherein for a first game option, formation of the set of symbols includes the game controller randomly selecting at least one mystery symbol from a set of mystery symbols for use at a first subset of the plurality of designated symbol positions and using predefined symbols at the designated symbol positions not used at the first subset of the plurality of designated symbol positions, and for a second game option, formation of the set of symbols includes the game controller randomly selecting at least one of the mystery symbols for use at the first subset of the plurality of designated symbol positions and a second subset of the plurality of designated symbol positions;

generate, by the game controller, a game outcome by selecting subsets of the symbols from the respective plurality of reels of the formed set of symbols for display on the display; and evaluate the symbols displayed at the symbol display positions in the game outcome to determine whether the game outcome corresponds to a winning combination of symbols.

17. The gaming system as claimed in claim 16, wherein each subset of the plurality of designated symbol positions corresponds to one of the plurality of reels.

18. The gaming system as claimed in claim 17, wherein the set of symbols includes a subset of the plurality of designated symbol positions for each of the plurality of reels.

19. The gaming system as claimed in claim 18, wherein the plurality of designated symbol positions are contiguous.

20. The gaming system as claimed in claim 19, wherein the symbols of at least one subset of the plurality of designated symbol positions are different from the symbols of at least one other subset of the plurality of designated symbol positions.

21. The gaming system as claimed in claim 20, wherein the symbols of each of a plurality of subsets of the plurality of designated symbol positions are different from the symbols of at least one other subset of the plurality of designated symbol positions.

22. The gaming system as claimed in claim 16, wherein there are N reels, N game options, and N subsets of designated symbols, and wherein, for each of game options 1 to N−1, the predefined symbols are used at the remainder of the designated symbol positions not used in the first through $(N-1)^{th}$ subsets of designated symbol positions.

23. The gaming system as claimed in claim 16, wherein the game controller randomly selecting at least one mystery symbol for more than one subset of the plurality of designated symbol positions comprises the game controller selecting a common mystery symbol to be used in respect of all of the subsets.

24. The gaming system as claimed in claim 16, wherein the game controller randomly selecting at least one mystery symbol for more than one subset of the plurality of designated symbol positions comprises the game controller separately randomly selecting a mystery symbol for each of the subsets.

25. The gaming system as claimed in claim 16, for a further game option, the game controller forms the set of symbols by using the predefined symbols at each of the plurality of designated symbol positions.

26. The gaming system as claimed in claim 16, wherein the game controller evaluates the symbols displayed at the plurality of symbol positions to determine whether a trigger condition is met, and upon the trigger condition being met, generates at least one further game outcome, and makes an award upon the symbols of the at least one further game outcome that includes a winning combination of symbols.

27. The gaming system as claimed in claim 26, wherein the game controller, for at least one of the game options, treating the at least one mystery symbol from the set of mystery symbols on a reel of the plurality of reels as a wild symbol during the further game outcome.

28. The gaming system as claimed in claim 26, wherein the game controller, for at least one of the game options, changing the at least one mystery symbol from the set of mystery symbols on a reel of the plurality of reels to a wild symbol.

29. The gaming system as claimed in claim 27, wherein the game controller treats any other symbols on the reel that includes the at least one mystery symbol from the set of mystery symbols on the reel of the plurality of reels as the wild symbol.

30. The gaming system as claimed in claim 28, wherein the game controller changes any other symbols on the reel that includes the at least one mystery symbol from the set of mystery symbols on the reel of the plurality of reels to the wild symbol.

31. A game controller for a gaming system, the game controller comprising:

a processor;

a memory, the memory which stores instructions and reel data defining at least a plurality of reels, the instructions which when executed by the game controller, cause the game controller to at least:

in response to receiving an instruction from an input device, select a selected game option selected from one of a plurality of game options;

in response to the selected game option, form a set of symbols for each of the plurality of reels to be used in generating at least one game outcome, wherein a symbol of the set of the symbols of each of the plurality of reels, is located at a symbol position of the plurality of symbol positions, and wherein for each of the plurality of reels, one or more of the symbols of the set of symbols at at least one of the plurality of symbol positions is fixed and the symbols of the set of symbols are not fixed at one or more of the plurality of designated symbol positions are selected, and wherein for a first game option, formation of the set of symbols includes the symbol set former randomly selecting at least one mystery symbol from a set of mystery symbols for use at a first subset of the plurality of designated symbol positions and using predefined symbols at the designated symbol positions not used at the first subset of the plurality of designated symbol positions, and for a second game option, formation of the set of symbols includes the symbol set former randomly selecting at least one of the mystery symbols for use at the first subset of the plurality of designated symbol positions and a second subset of the plurality of designated symbol positions;

generate a game outcome by selecting subsets of the symbols from the respective plurality of reels of the formed set of symbols for display on the display; and evaluate the symbols displayed at the plurality of symbol display positions in the game outcome to determine if the game outcome corresponds to a winning combination of symbols.

32. The game controller as claimed in claim 31, wherein each subset of the plurality of designated symbol positions corresponds to one of the plurality of reels.

33. The game controller as claimed in claim 31, wherein the set of symbols includes a subset of plurality of designated symbol positions for each of the plurality of reels.

34. The game controller as claimed in claim 33, wherein the plurality of designated symbol positions are contiguous.

35. The game controller as claimed in claim 34, wherein the symbols of at least one subset of the plurality of designated symbol positions are different from the symbols of at least one other subset of the plurality of designated symbol positions.

36. The game controller as claimed in claim 35, wherein the symbols of each of a plurality of subsets of the plurality of designated symbol positions are different from the symbols of at least one other subset of the plurality of designated symbol positions.

37. The game controller as claimed in claim 31, wherein there are N reels, N game options, and N subsets of designated symbols, and wherein for each of game options 1 to N−1, the predefined symbols are used at the designated symbol positions not used at the first through $(N-1)^{th}$ subsets of designated symbol positions.

38. The game controller as claimed in claim 31, wherein the game controller randomly selecting at least one mystery symbol for more than one subset of the plurality of designated symbol positions comprises the game controller selecting a common mystery symbol to be used in respect of all of the subsets.

39. The game controller as claimed in claim 31, wherein the game controller randomly selecting at least one mystery symbol for more than one subset of the plurality of designated symbol positions comprises the game controller separately randomly selecting a mystery symbol for each of the subsets.

40. The game controller as claimed in claim 31, for a further game option, the game controller forming the set of symbols by using the predefined symbols at each of the plurality of designated symbol positions.

41. The game controller as claimed in claim 31, wherein the game controller evaluates the symbols displayed at the plurality of symbol display positions to determine whether a trigger condition is met, and upon the trigger condition being met generates at least one further game outcome, and makes an award upon the symbols of the at least one further game outcome that includes a winning combination of symbols.

42. The game controller as claimed in claim 41, wherein the game controller, for at least one of the game options, treats at least one mystery symbol from the set of mystery symbols on a reel of the plurality of reels as a wild symbol during the further game outcome.

43. The game controller as claimed in claim 41, wherein the game controller, for at least one of the game options, changing at least one mystery symbol from the set of mystery symbols on a reel of the plurality of reels to a wild symbol.

44. The game controller as claimed in claim 42, wherein the game controller treats any other symbols on the reel that includes the at least one mystery symbol from the set of mystery symbols as the wild symbol.

45. The game controller as claimed in claim 43, wherein the game controller changes any other symbols on the reel that includes the at least one mystery symbol from the set of mystery symbols to the wild symbol.

* * * * *